US005921125A

United States Patent [19]

Inoue et al.

[11] Patent Number: 5,921,125

[45] Date of Patent: Jul. 13, 1999

[54] CONTROL METHOD OF TERMINAL CRIMPING DEVICE

[75] Inventors: Toshihiro Inoue; Tatsuya Maeda; Mitsuru Yoshikawa; Chiaki Hatano; Yukinori Takano, all of Shizuoka, Japan

[73] Assignee: Yazaki Corporation, Tokyo, Japan

[21] Appl. No.: 08/871,950

[22] Filed: Jun. 10, 1997

Related U.S. Application Data

[30] Foreign Application Priority Data

Jun. 12, 1996 [JP] Japan ..... 8-151141

[51] Int. Cl.[6] ..... B21B 37/00

[52] U.S. Cl. ..... 72/20.2; 72/31.11; 72/441; 72/452.5; 29/705; 29/753

[58] Field of Search ..... 72/15.1, 17.2, 72/19.8, 20.1, 20.2, 21.1, 21.2, 21.3, 31.11, 374, 412, 414, 441, 443, 446, 453.14, 28.1, 29.2, 452.5; 29/705, 753, 863

[56] References Cited

U.S. PATENT DOCUMENTS

| | | | |
|---|---|---|---|
| 4,856,186 | 8/1989 | Yeomans | 29/863 |
| 4,936,126 | 6/1990 | Sato | 72/20.1 |
| 5,092,026 | 3/1992 | Klemmer et al. | 29/863 |
| 5,123,165 | 6/1992 | Strong et al. | 29/705 |
| 5,168,736 | 12/1992 | Enneper et al. | 72/21.3 |
| 5,228,326 | 7/1993 | Wasilko et al. | 29/863 |
| 5,337,589 | 8/1994 | Gloe et al. | 29/753 |
| 5,443,549 | 8/1995 | Mimuro et al. | 29/753 |
| 5,491,994 | 2/1996 | Baldyga | 72/20.1 |
| 5,669,257 | 9/1997 | Inoue et al. | 72/20.1 |
| 5,697,146 | 12/1997 | Inoue et al. | 72/21.3 |
| 5,704,110 | 1/1998 | Erhard et al. | 29/705 |

FOREIGN PATENT DOCUMENTS 8-236253 9/1996 Japan .

*Primary Examiner*—Joseph J. Hail, III
*Assistant Examiner*—Ed Tolan
*Attorney, Agent, or Firm*—Armstrong, Westerman, Hatiori, McLeland & Naughton

[57] ABSTRACT

A method of controlling a terminal press attaching device by providing a elevating crimper for crimping terminals onto exposed conductors of the cables, setting an anvil opposite to the crimper, and elevating the drive means including a servo motor. More specifically, the crimp height for press attached terminals is monitored, a detected height and the predetermined set value are compared to control said drive means such that the detected height is made equal to the set value. Thus, the crimp height of the terminal to be attached (or the crimper height) is automatically and easily adjusted.

3 Claims, 9 Drawing Sheets

CONTROL METHOD OF TERMINAL CRIMPING DEVICE

BACKGROUND OF THE INVENTION

1. Field of the Invention

The present invention relates to a method of controlling a terminal crimping device which produces terminal-equipped cables constituting a wire harness or the like.

2. Description of the Related Art

The terminal crimping device is, in general, composed of a crimper and an anvil set opposite to said crimper wherein the crimper performs the work of crimping terminals to the exposed conductors of the cables through elevating actions thereof. In this connection, Japanese Patent Appln. No. 6-328827 discloses that the elevating actions are achieved by decelerating the rotation of the servo motor before being transmitted to a disk where the disk rotation is converted into a linear motion such that a ram loaded with said crimper is elevated and lowered. A detailed explanation thereof will be given with reference to FIGS. 9A, 9B, 9C, 10A and 10B.

FIGS. 9A through 9C are figures explaining the action of the terminal crimping device; FIG. 10A is a graph showing the relationship between the crimper action time and the elevating speed; and FIG. 10B is a graph showing the relationship between the time and the motor current value wherein 1, 2, 3 in FIGS. 10A and 10B correspond to A, B and C in FIGS. 9A–C.

Referring to FIG. 9, the disk 7 is secured to the output shaft of the decelerator (not shown), which functions to decelerate the rotation of the servo motor.

The disk 7 secured at an axis thereof to the output shaft of the decelerator carries an eccentric pin (crank shaft) 8 thereon. A crank rod 9 is pivotally attached at an upper end thereof to said eccentric pin 8 while the crank rod 9 is pivotally attached at a lower end thereof to a ram 11. The ram 11 is loaded slidably in a vertical direction within a ram guide which is provided within the inner surfaces of a frame (not shown). In this way, the disk 7, the crank rod 9, the ram 11 and the ram guide constitute a piston/crank mechanism.

The ram 11 is formed at a lower end thereof an engagement recess 13, which is removably loaded with an engagement head 16 of a crimper holder 15 carrying a crimper 14. Immediately beneath said crimper 14, an anvil 17 is secured to a base 2 positioned opposite to said crimper 14.

FIG. 9A shows the start of the crimping step in which the crank pin 8 of the disk 7 takes an uppermost position to place the crimper 14 in the top dead center, when the descending speed of the crimper 14 stands at 0 while the load current stands at 0 as shown in FIG. 10A.

FIG. 9B shows a rotation of the disk 7 in the arrow-marked direction which causes the eccentric pin 8 to move downward until the crimper 14 reaches a position in its high speed descent to contact the barrel c of a terminal, thus starting a crimping action therefor. The descending speed of the crimper 14 is reduced before the contact thereof while reducing the load current.

FIG. 9C shows that the disk 7 rotates in the arrow-marked direction to move the eccentric pin 8 to the neighborhood of the bottom dead center such that the crimper 14 and the anvil 17 substantially performs the crimping work and, then, the crimper 14 provisionally comes to a stop at the crimping position. At this time, the crimper 14 is at rest (stop time t) showing a speed 0 while maintaining the state of pressurizing and pinching the barrel c of the terminal to continue the pressurizing action against the springback of the terminal barrel c, thus the load current reaching the peak value while showing a rising curve. Springback of the barrel c is prevented through this pressurizing and pinching action by this provisional halt.

After the terminal crimping , the servo motor 4 is caused to rotate the disk 7 in a direction reverse to the arrow-marked direction in the state shown in FIG. 9C such that the crimper 14 ascends to restore to the state A.

In FIG. 10A, the descending speed of the crimper 14 is sufficiently reduced from the speed thereof shown during the descent from the uppermost position to the terminal crimping start position. Therefore, such impact noise as caused in a conventional flywheel type terminal crimping device will not be generated, thus contributing to noise prevention and job site improvement.

Further, the crimp height (crimping height) of the terminals to be press-attached has been adjusted by changing the position of the crimper 14 by manually operating a screw.

As explained in the foregoing description, the conventional adjustment of the crimp height for the terminals to be attached is done by manually operating a screw of the crimper holder.

Therefore, if there is a change in the crimp height of the product attributable to wear of the tightening type mold (for crimpers or anvils) or change in the temperature at the start of crimping new terminals or thereafter, the need for stopping the device to make manual adjustments of the crimper height often arises, thus causing a great deal of trouble and inconveniences.

SUMMARY OF THE INVENTION

An object of the present invention is to provide a method of controlling a terminal crimping device which facilitates an automatic adjustment of the crimp height (or crimper height) of the terminals to be press attached.

In order to accomplish the object of the present invention, there is provided a method of controlling a terminal crimping device composed of an elevating crimper for crimping terminals onto exposed conductors of cables and an anvil positioned opposite said elevating crimper, wherein the crimper is caused by drive means including a servo motor to perform an elevating action, the method comprising the steps of monitoring a height of the crimper; comparing a detected height thereof and a preset value; and controlling the drive means such that the detected height is equal to the preset value.

Preferably, the controlling of the drive means is effected by controlling a drive current of the servo motor at the time of crimping.

Further, preferably, the control of the drive means is performed by starting the controlling at the time of the height of the crimper exceeding the preset administration value.

Furthermore, preferably, the control of the drive means is started when the rate at which the height of the crimper exceeding the administration value is more than the preset value.

Since the present invention provides that the crimp height ( or the height of the crimper) of the terminal to be crimped is monitored, the detected height thereof and a preset value are compared, and the drive means are controlled such that the detected height is equal to the preset value, the adjustment of the crimp height to make the crimp height equal to the preset value without the need for manual operation thereof.

Further, since the crimp height is made equal to the preset value by controlling the drive means, the adjustment can be effected by a simple construction of the device.

Further, since the control is adapted to start when the crimper height exceeds the preset administration value or when the rate at which the crimp height exceeds an administration value is equal to or more than the preset value, the automatic adjustment is started when a change in the crimper height arises due to wear or temperature aging, thus improving the crimping performance.

The above and other object and features of the present invention will be more apparent from the following description taken in conjunction with the accompanying drawings.

DESCRIPTION OF THE PREFERRED EMBODIMENTS

Figure 1:
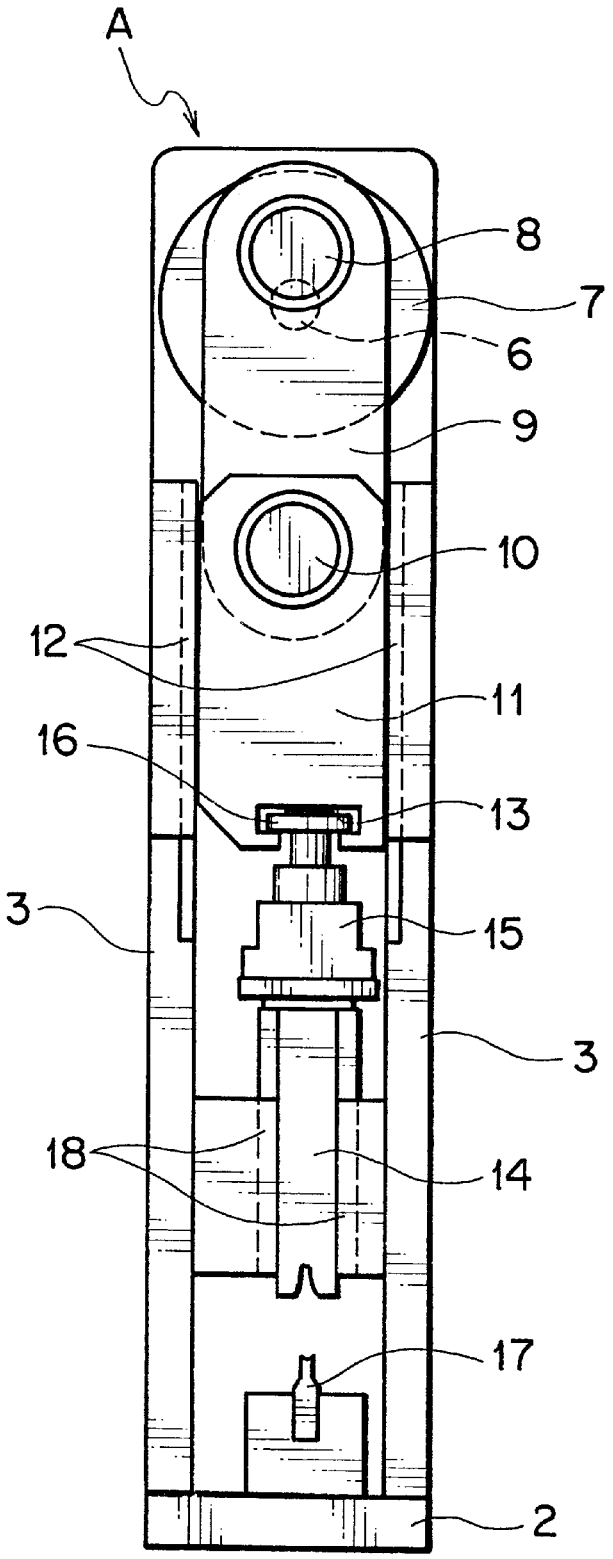
FIG. 1 is a front view of the terminal crimping device showing one embodiment of the present invention.
Figure 2:
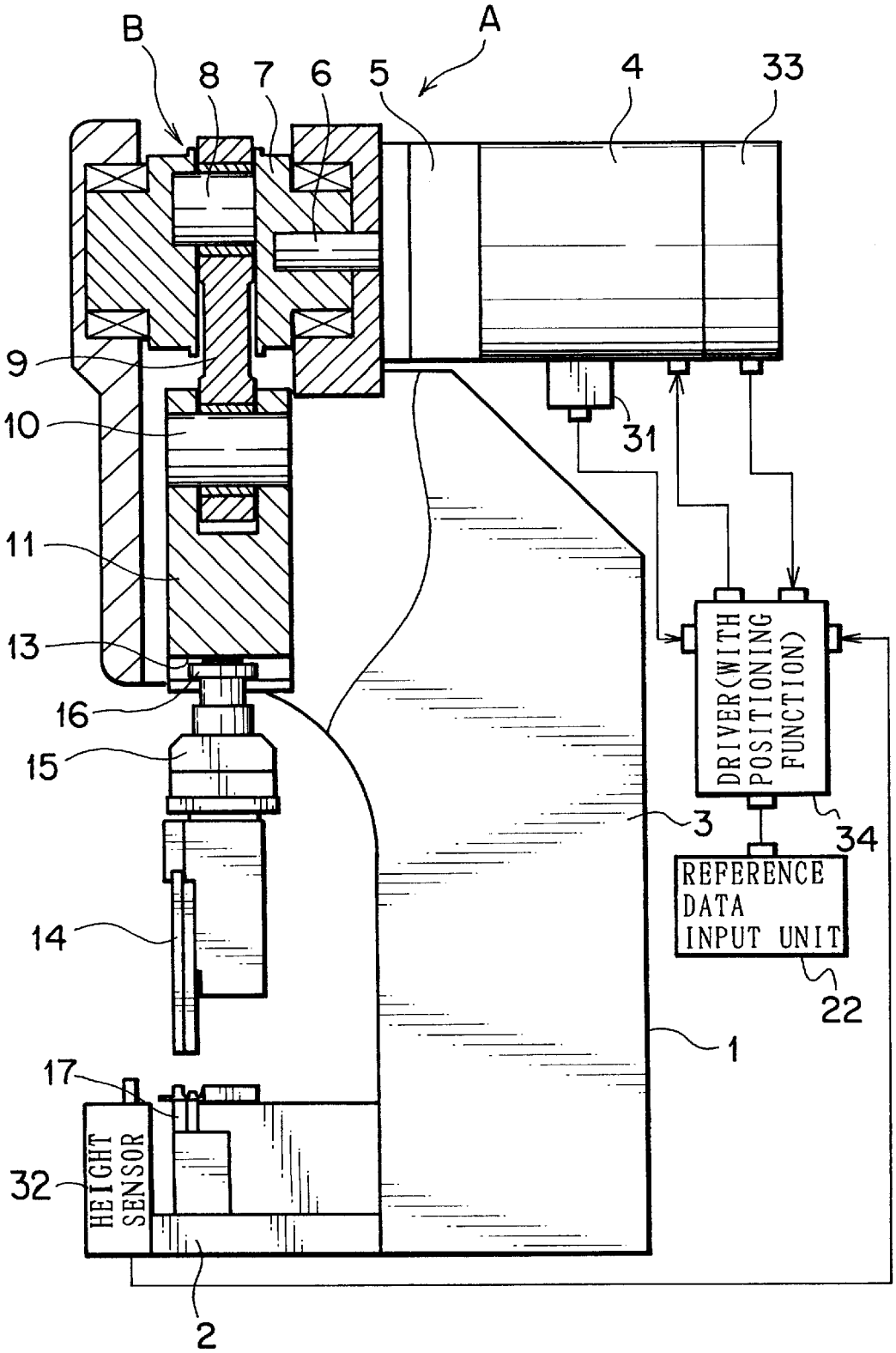
FIG. 2 is a side elevation of FIG. 1.

In FIGS. 1 and 2, reference numeral 1 denotes a casing of a terminal crimping device A which is generally composed of a base 2 and opposite side plates 3 thereof. Above the opposite side plates 3, a servo motor 4 having a reduction gear 5 is mounted thereto to extend rearwardly thereof. The reduction gear 5 has an output shaft 6 which is secured to a disk 7 having an eccentric pin (crank shaft) 8. There is provided a crank rod 9 having an upper end pivotally attached to the eccentric pin 8. The crank rod 9 further has a lower end again pivotally attached to a ram 11 via a pin shaft 10. The ram 11 is loaded within ram guides 12 attached to the inner walls of the opposite side plates 3 such that the ram 11 is adapted to slide upwardly and downwardly therebetween. Thus, the disk 7, the crank rod 9 and the ram guides 12 constitute a piston/crank mechanism B.

The ram 11 is formed with an engagement recess 13 at an underside thereof such that an engagement head 16 formed in the crimper holder 15 attached to the crimper 14 is removably engaged in the engagement recess 13. Immediately beneath the crimper 14, there is set an anvil 17 mounted on the base 2 in opposite relation to the crimper 14. The numeral 18 denotes guide plates for guiding the crimper holder 15 which are secured to the inner faces of the side plates 3 by way of brackets.

The servo motor 4 is adapted to rotate forwardly and backwardly such that the piston/crank mechanism B causes the ram 11 pivotally attached to the crank rod 9 and, thus, the crimper 14 to descend and ascend, the motor 4 being connected to the driver 34 which controls the operation thereof. A reference data input unit 22 to the driver 34 is connected to the driver 34 for inputting thereto reference data including terminal standards (or sizes), cable sizes corresponding thereto, crimper heights (or lowest crimper positions) and loads (or electric currents) applied to the servo motor 4 or the like.

The servo motor 4 has an output shaft (not shown) attached to a rotary encoder 33 which detects positions of the crimper 14 on the basis of the number of its rotation to be fed back to the driver 34 which reads out the load current.

Numeral 32 denotes a height sensor which detects the height of the crimper 14 at the time of terminal crimping operation to input the same to the driver 34 for determining whether the performance of the terminal attaching operation is good or not. The numeral 31 denotes a temperature sensor for measuring the temperature of the coil of the servo motor 4.

Figure 3:
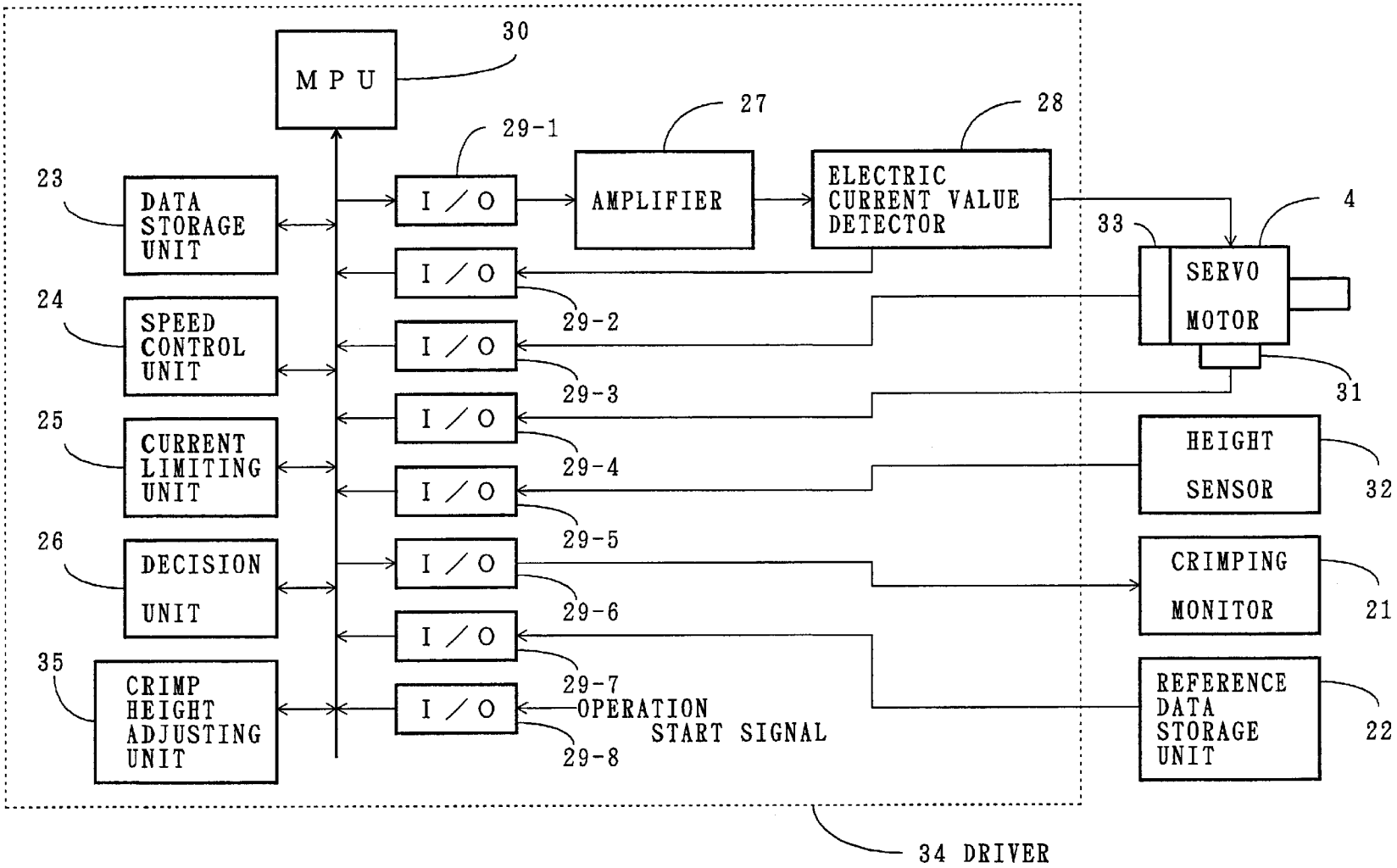
FIG. 3 is a function block diagram showing the control sequence of the terminal crimping device in FIG. 1.

FIG. 3 is a function block diagram of the driver 34 which drives the servo motor 4. As shown therein, the driver 34 is incorporated as a control circuit like a central processing unit; that is, the driver 34 is composed of data storage unit 23, speed control unit 24, current limiter 25, a decision unit 26, amplifier 27, an electric current value detector 28, an interface (I/O) 29 (29-1 through 29-8) and a microprocessor (MPU) 30 which performs the processing work.

The operating principle of the terminal crimping device will not be explained since it is substantially the same as explained referring to FIGS. 9A–C and 10A and B which show the prior art.

Now back to FIG. 3, data for driving the terminal crimping device A and data for determining whether the performance of the terminal crimping operation is good or not will be stored in advance into the data storage unit 23 by way of I/O 29-7 from the reference data input unit 22 prior to starting the operation of the terminal crimping device A.

Figure 10A:
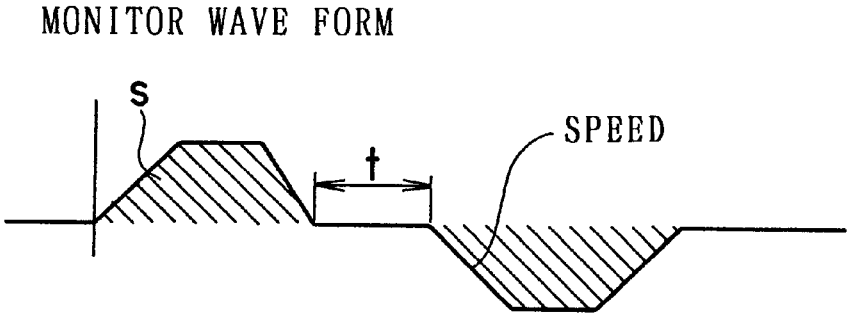
FIG. 10A PRIOR ART
FIG. 10A is a graph showing the relationship between the crimper time and elevating speed thereof during the terminal crimping operation.
Figure 10B:
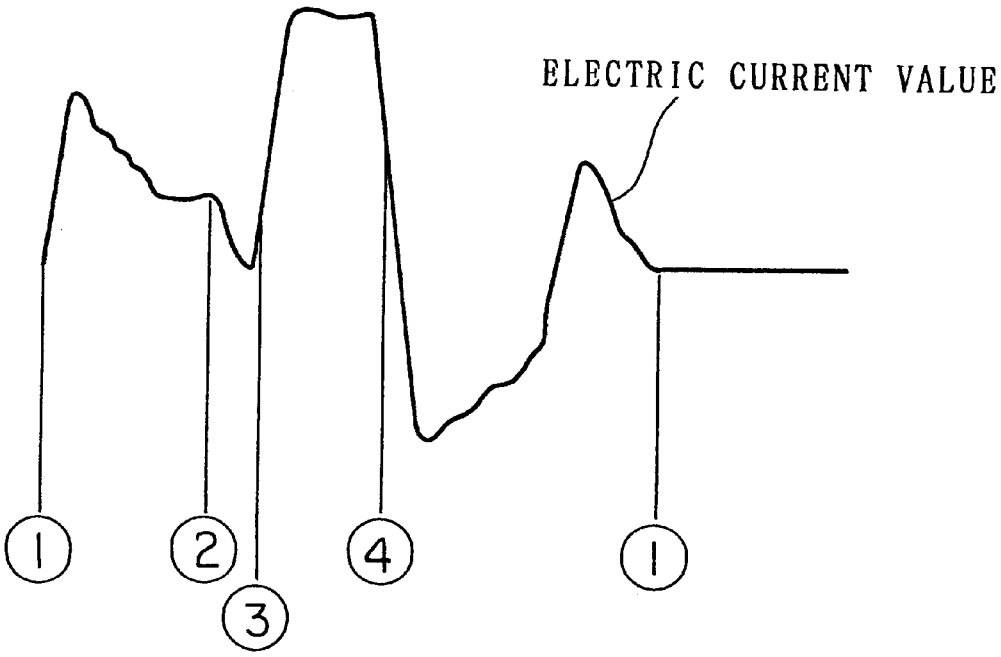
FIG. 10B PRIOR ART
FIG. 10B is a graph showing the relationship between the similar time and the motor current value.

More specifically, the data to be stored for driving the terminal crimping device A as shown in FIG. 10B include (i) the acceleration after the start of a forward rotation of the motor and the position of the crimper 14 descending by the rotation of the motor at the time of the motor reaching a uniform speed, (ii) the position of the crimper 14 decelerated from the uniform speed and the deceleration at that time, (iii) the position of the crimper 14 at the time of starting the crimping, the given time period t and the drive current for driving the motor for said given time period, and (iv) the acceleration at the time of reversing the motor after completion of the crimping to elevate the crimper 14, the position of the crimper 14 when the motor speed is brought to a uniform speed, the position of the crimper 14 when the motor is decelerated, and the position of the crimper 14 at a stop.

The positions of the crimper 14 are stored as values related to the output values of the rotary encoder 33 attached to the servo motor 4.

These data are obtained by conducting preliminary experiments for respective terminals to be press attached and the thus obtained data are stored. In this connection, the data corresponding to a plurality of terminals may be stored such that a relevant data are to be read out at the time of the operation.

The data for determining whether the performance of the terminal crimping operation is good or not will be explained later on.

Next, the operation of the driver 34 will be explained with reference to FIGS. 6 and 7, which show a flow chart of the driver operation.

At step S1, the speed control unit 24 determines whether or not the signal for starting the crimping operation has been inputted and if the determination is NO, the program is suspended until YES.

At step S2, the speed control unit 24 reads out from the data storage unit 23 the acceleration for causing the servo motor 4 to rotate forwardly and the acceleration is outputted to the amplifier 27 by way of I/O 29-1 where the power amplification is effected to supply the electric current to the servo motor 4 such that the required speed is obtained.

In this connection, the acceleration for the motor rotation is obtained by reading out the output value of the rotary encoder 33 by way of I/O 29-3, differentiating the read out value to obtain the speed, and further differentiating the speed to obtain the acceleration.

At the step S3, the speed control section 24 determines whether or not the output value of the rotary encoder 33 inputted by way of I/O 29-3 has become a uniform rotation position and if the determination is NO, the acceleration applied at step S2 is continuously effected and if YES, the program proceeds to step S4 where the uniform speed rotation is effected.

Further, if the position for decelerated rotation is detected at the step S5, the program proceeds to step S6 where the speed control unit 24 reduces the motor rotation. At step 7, the terminal reaches the crimping position, when the current control unit 25 is thus notified.

At step S8, the current control unit 25 reads out the electric current value I which is stored at the data storage unit 23 to be supplied to the servo motor 4 at the time of terminal crimping operation. Then, the program proceeds to step S9 where an amendment is made thereto on the basis of the temperature value from the temperature sensor 31 inputted by way of I/O 29-4 such that the torque of the servo motor 4 reaches the prescribed value to output the value at step S10 by way of I/O 29-1.

At step S11, the decision unit 26 stores the determination data to a memory not shown. The data for determination will be explained in detail later on.

At step 12, the electric current control unit 25 determines whether or not the electric current I is supplied to the servo motor 4 for a time period t and if the determination is NO, the program proceeds to the step S10 for execution of the steps S10 and S11.

At step 13, the speed control unit 24 causes the servo motor 4 to rotate by accelerating the same to obtain a designated acceleration in the backward direction until a value for the uniform speed rotation is determined at step S14 as having been obtained. Then, the program proceeds to step S15 to achieve a uniform speed rotation. At the step 16, if the position for reduction speed rotation is determined as having been reached, the program proceeds to step S17 for decelerated rotation, and at step S18 the rotation is stopped when the stop position is reached.

At step S19, the decision unit 26 determines whether crimping is good or not on the basis of the data recorded at the step S11. Then, at the step 20, an alarm is issued if necessary in the event of "not good" while the result is displayed 21 on the crimping monitor 21.

The determination whether the crimping is good or not is recorded at the step S11 at an interval of predetermined time period in the form of the electric current value (drive value) detected by the current value detector 28 as having flowed through the servo motor 4 and the height detected by the height sensor 32 are recorded.

The current control unit 25 controls such that the uniform electric current having a value stored at the data storage unit 23 is supplied to the motor. Although a uniform electric current is supplied while the motor is at a stop, the control balance is lost by crimping operation when the motor starts to rotate with the result that the drive electric current varies. When crimping a terminal to a coreless cable or an unpeeled cable, it is often observed that the current supplied is larger than when crimping a normal terminal or that the total supply electric current is smaller. Therefore, the determination of good or not in accordance with the preset amount is effected on the basis of a variation of the current supplied in correspondence with the crimping height.

Figure 7:
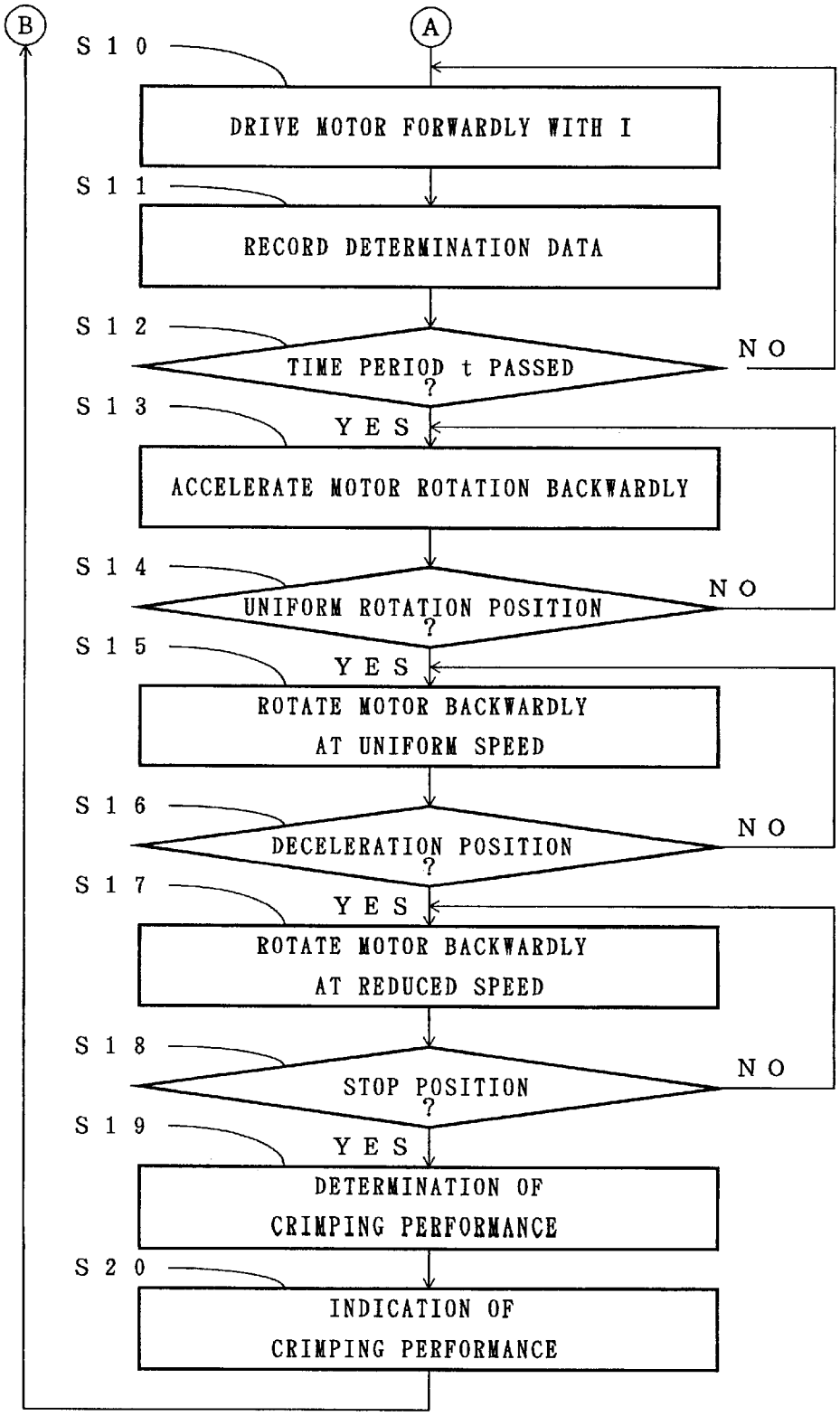
FIG. 7 is a flow chart showing the operation in FIG. 3.
Figures 1, 9A, 9B, 9C:
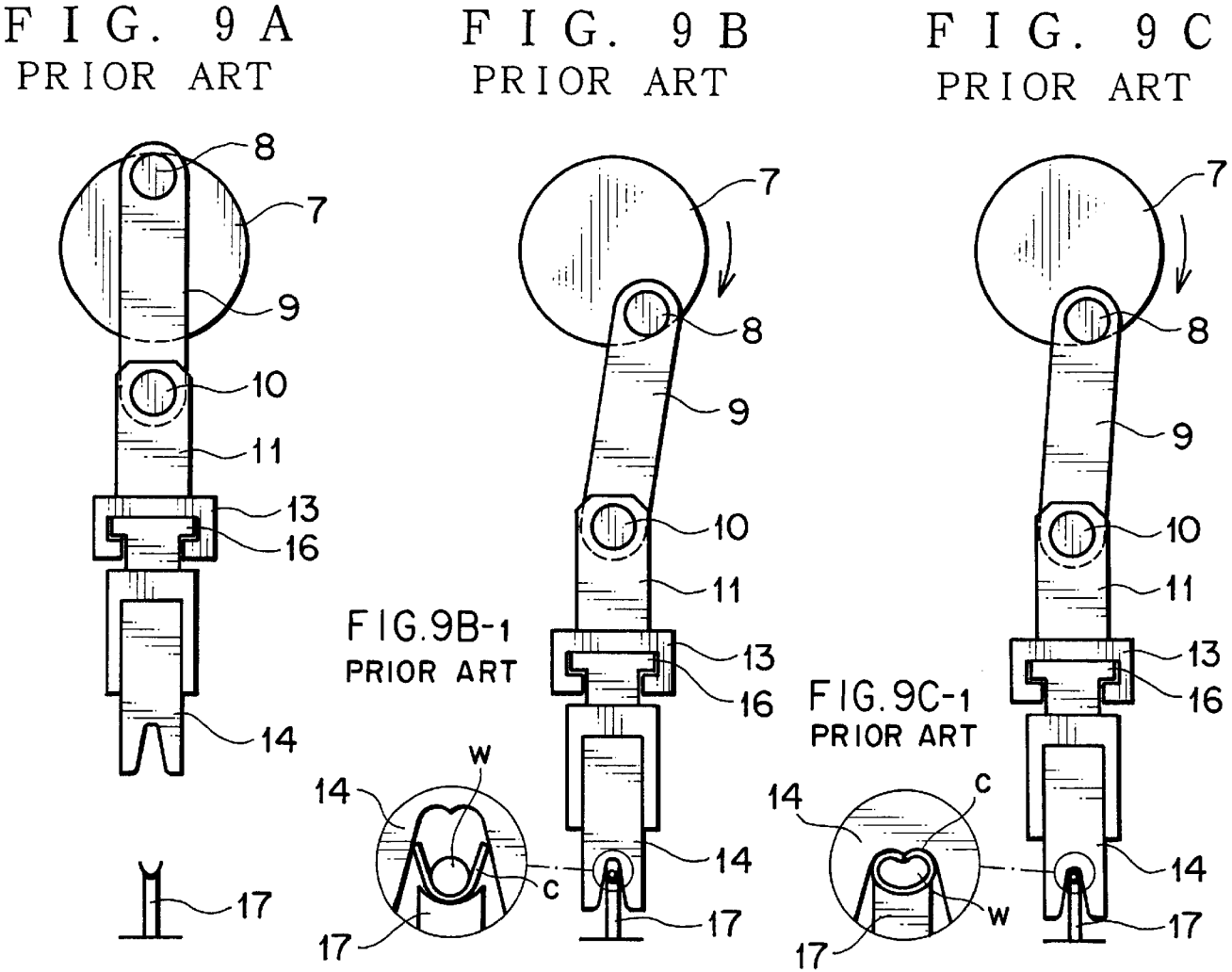
FIG. 9A PRIOR ART
FIG. 9B PRIOR ART
FIG. 9B-1 PRIOR ART
FIG. 9C PRIOR ART
FIG. 9C-1 PRIOR ART
FIGS. 9A through 9C show views explaining the function of the terminal crimping device (FIG. 1)

At the determination unit 26, there are recorded reference values X0, X1, X2 - - - Xn of the torque value (electric current value) to the crimp height (C/H) as shown in FIG. 7 and predetermined values (3σ) to the respective reference values X0, X1, X2 - - - Xn.

Figure 8:
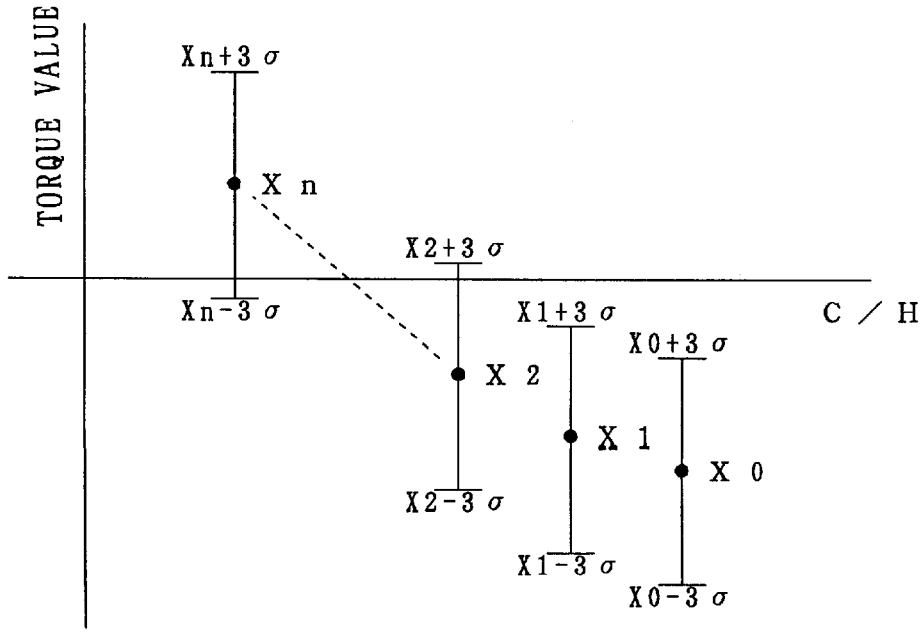
FIG. 8 is a view for explaining the decision value.

At step S19, the decision unit 26 determines whether or not the data values recorded at step S11 are within the range of predetermined allowances as explained referring to FIG. 8 and if the value is within said range, it is determined "good", and if outside thereof, it is determined "not good".

Figure 6:
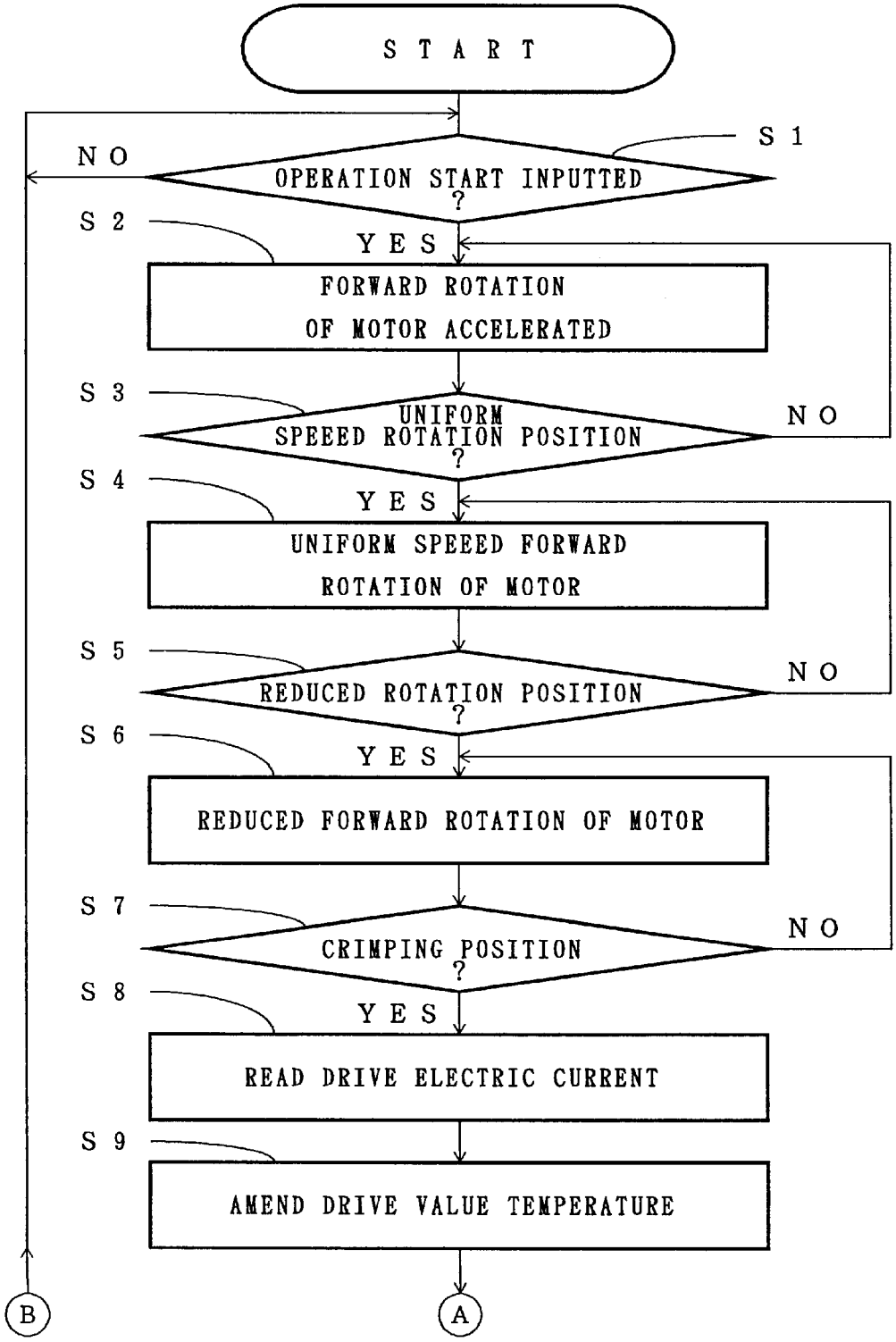
FIG. 6 is a flow chart showing the operation in FIG. 3.

The flow chart explained in FIG. 6 and FIG. 7 is a operation flow of the terminal press attaching. Along with these figures, the crimper height adjustment unit 35 dictates the adjustment operation of the height of the crimper 14 following the flow shown in FIG. 4.

Figure 4:
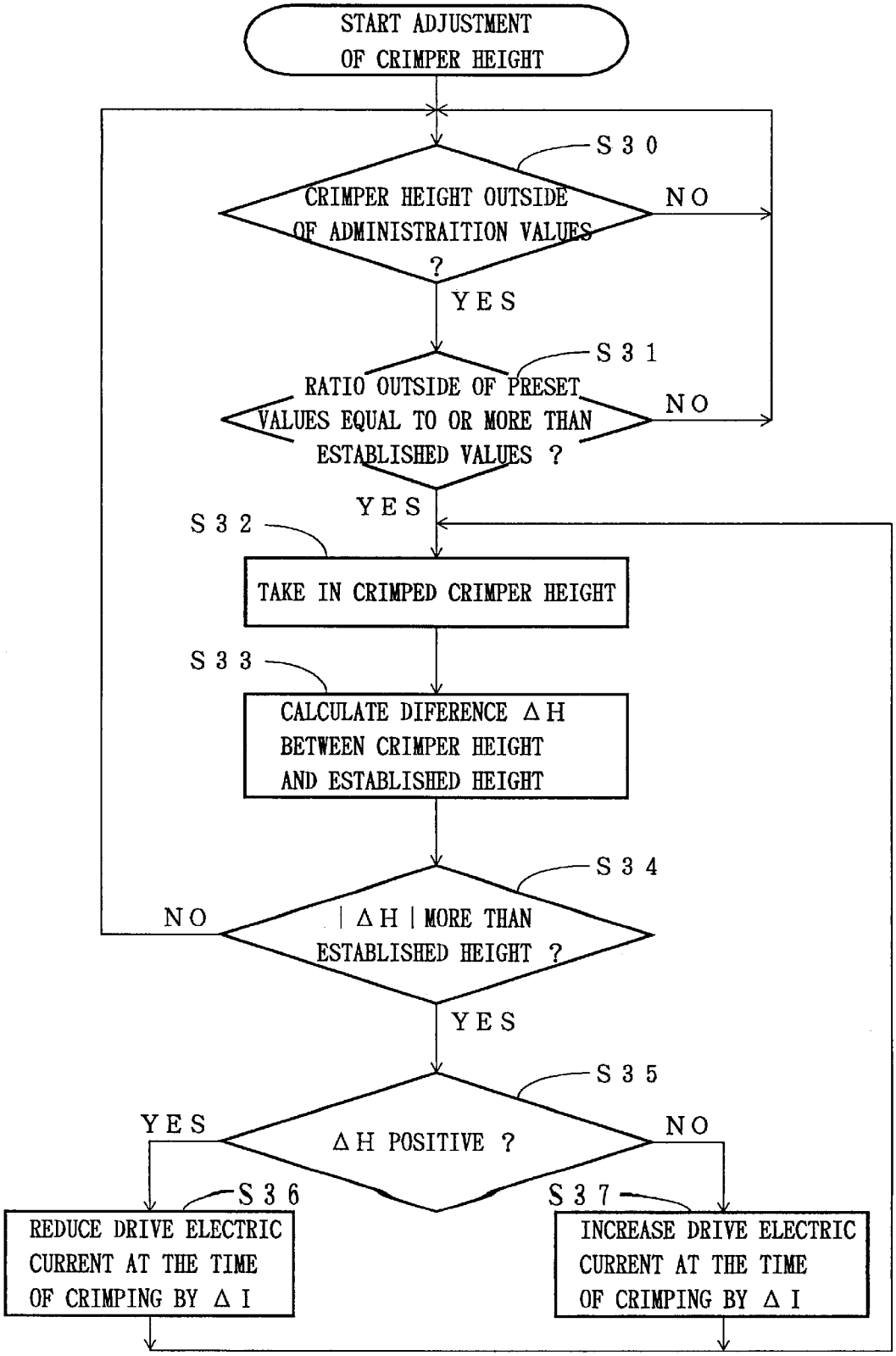
FIG. 4 is an operation flow chart of the crimper height adjustment unit.

In FIG. 4, it is determined at the step S30 whether or not the crimp height for the terminals to be attached is out of conformity with the administration values and if NO, the program is suspended until YES.

Figure 5:
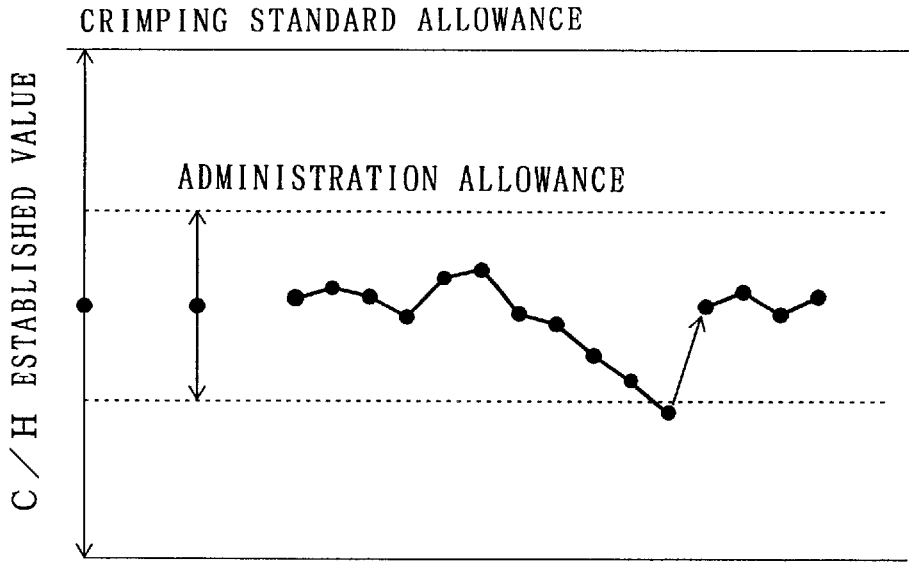
FIG. 5 is a view for explaining the set value, the standard value, and the administration value of the crimper height.

In other words, the set value of the crimp height (C/H) of the terminals to be attached, the press attaching standard value to determine products as being rejects and the administration values for administering the crimp height for the products are recorded as shown in FIG. 5. It is thereby determined whether or not the crimp height for the terminals to be attached is outside of the administration values at the step S30.

At the step S31, it is determined whether or not the rate determined at the step S30 as being out of conformity with the administration values is equal to or more than the set value, and if NO, the program proceeds to the step S30.

In this way, the adjustment is adapted to start after the crimp height is different from the set values on the average by determining whether or not the rate is equal to or more than the set value.

At the step S32, the crimp height of the terminals to be press attached is taken in and the program proceeds to the step S33 where the difference thereof from the set values are calculated.

At the step S34, it is determined whether or not $|\Delta H|$ is larger than the set value smaller than the administration value and if the determination is NO, it is judged as the adjustment being completed such that the program proceeds to the step S30.

If the determination at the step S34 is YES, in other words, if the crimp height is, away from the set value, the program proceeds to the step S35, where it is determined whether or not $|\Delta H|$ obtained at the step S33 is correct. If correct, the program proceeds to the step S36, where the drive current $\Delta I$ is decreased at the time of crimping and if negative, the program proceeds to the step S37, where the drive current at the time of crimping is increased by $\Delta I$ and the program process to the step S32.

The decrease of ΔI at the step S36 and the increase of ΔI at the step S37 are recorded at the current control unit 25 by making amendments to the drive electric current value read out at the step S8 in FIG. 6.

What is claimed is:

1. A method of controlling a terminal press attaching device composed of an elevating crimper for crimping terminals onto exposed conductors of cables and an anvil positioned opposite said elevating crimper wherein said crimper is caused by drive means including a servo motor to perform an elevating action, said method comprising the steps of:

monitoring a height of the crimper; comparing a detected height thereof and a preset value; and controlling the drive means such that the detected height is equal to the preset values, wherein said controlling of said drive means is effected by controlling a drive current of the servo motor at the time of crimping.

2. A method of controlling a terminal press attaching device according to claim 1, wherein the control of said drive means is performed by starting the controlling at the time of the height of the crimper exceeding the preset administration value.

3. A method of controlling a terminal press attaching device according to claim 1, wherein the control of said drive means is started when the rate at which the height of the crimper exceeding the administration value is more than the preset value.

* * * * *